US005093220A

United States Patent [19]

Masaki et al.

[11] Patent Number: 5,093,220

[45] Date of Patent: Mar. 3, 1992

[54] ELECTROSTATIC LATENT IMAGE DEVELOPER

[75] Inventors: Hiroya Masaki; Meizo Shirose; Michiaki Ishikawa; Hiroyuki Takagiwa, all of Hachioji, Japan

[73] Assignee: Konica Corporation, Tokyo, Japan

[21] Appl. No.: 461,129

[22] Filed: Jan. 5, 1990

[30] Foreign Application Priority Data

Jan. 11, 1989 [JP] Japan ..... 1-5383

[51] Int. Cl.[5] ..... G03G 9/00

[52] U.S. Cl. ..... 430/109; 430/110

[58] Field of Search ..... 430/109, 110

[56] References Cited

U.S. PATENT DOCUMENTS

| | | | |
|---|---|---|---|
| 4,882,258 | 11/1989 | Ikeuchi et al. | 430/109 X |
| 4,883,734 | 11/1989 | Ikeuchi et al. | 430/109 |
| 4,902,570 | 2/1990 | Heinemann et al. | 430/110 X |
| 5,021,317 | 6/1991 | Matsubara et al. | 430/110 |

FOREIGN PATENT DOCUMENTS

| | | | |
|---|---|---|---|
| 288693 | 11/1988 | European Pat. Off. | 430/110 |
| 3806595 | 9/1988 | Fed. Rep. of Germany | 430/108 |
| 3836388 | 5/1989 | Fed. Rep. of Germany | 430/110 |
| 1-114857 | 5/1989 | Japan | 430/110 |

OTHER PUBLICATIONS

Patent Abstracts of Japan, vol. 10, No. 290(P. 503)(2346); 10/2/86 JPA-61-110156; 5/28/86.

*Primary Examiner*—Marion E. McCamish
*Assistant Examiner*—S. Crossan
*Attorney, Agent, or Firm*—Jordan B. Bierman

[57] ABSTRACT

An electrostatic latent image developer that is composed of at least three components, toner resin particles containing at least a colorant, carrier particles and fine inorganic particles is disclosed. The improved feature of the developer is that said toner resin particles contain a resin crosslinked with a divalent metal or metals of higher valency and that said fine inorganic particles are surface-treated with an ionic silicone compound.

9 Claims, No Drawings

ELECTROSTATIC LATENT IMAGE DEVELOPER

BACKGROUND OF THE INVENTION

The present invention relates to developers for use in electrophotography.

Electrophotographic processes generally comprise the following steps: a charging step for forming a uniform charge layer on the surface of a photoreceptor; an exposure step in which an electrostatic latent image is formed by imagewise exposure; a development step for rendoring the electrostatic latent image visible by a colored toner; a transfer step for transferring the resulting toner image onto a recording member, typically paper; and a fixing step in which the transferred image is fixed as a copy image either with heat or under pressure.

Electrophotographic photoreceptors include a selenium photoreceptor, a zinc oxide photoreceptor, a cadmium sulfide photoreceptor, organic photoreceptors, an amorphous silicon photoreceptor, etc. Organic photoreceptors can not only be produced at low cost but they also have the advantages of high sensitivity, durability and heat resistance plus non-toxicity. With the recent expansion of the use of organic photoreceptors, a need has arisen for producing positively chargeable toners. In fact, however, the electrostatic latent image formed on the surface of common photoreceptors which have light-sensitive layers made of selenium and other inorganic materials has positive polarity and is rendered visible with developers having negatively chargeable toners. Thus, extensive R&D efforts have been made on developers having negatively chargeable toners but not on developers having positively chargeable toners which are useful in the development of organic photoreceptors. Under these circumstances, no satisfactory developers have yet been obtained that have positively chargeable toners.

Two types of developers are known that are useful in dry development: the first type is a one-component developer which is solely composed of a magnetic toner containing a magnetic material, and the second type is a two-component developer composed of a non-magnetic toner which is free from a magnetic material and a magnetic carrier.

In the absence of carriers, the one-component developer allows the toner particles to be electrified either by friction between themselves or by friction with the development sleeve in the developing unit or the blade for restricting the height of developer layer. As a result, toner particles charged positively intermingle with negatively charged ones and this fact, combined with the small quantity of triboelectrification, tends to make development instable. On the other hand, the two-component developer consists of a toner and a carrier, with the carrier having a capability for permitting the toner to be charged in a desired polarity. Thus, toner particles can be provided with triboelectric charges of appropriate polarity in an appropriate amount. In other words, the two-component developer is capable of by far improved triboelectrification over the one-component developer. Another advantage of the two-component developer is that the amount of charges on the toner can be controlled over a satisfactorily broad range by selecting a carrier having desired characteristics.

However, in order to obtain a final fixed image of good quality, efficient triboelectrification of the developer does not suffice and it is also necessary that the developer particles provided with triboelectric charges in the developing unit be transported in the developing space without agglomeration. Speaking of magnetic brush development, it is necessary that the developer provided with triboelectric charges by agitation in the developing unit be held on the development sleeve like a high-pile blanket in which the particles are uniformly aligned into thistles and that such a development layer be transported consistently through the developing space with the blanket being maintained.

If toner particles in a two-component developer are highly likely to agglomerate into lumps by an electrostatic cohesive force, it is difficult to disperse them in carrier particles at uniform concentration and the proportion of toner particles provided with a smaller quantity of triboelectric charges will decrease on account of reduced friction between toner and carrier particles. As a result, toner particles will be deposited on the non-image areas of the photoreceptor during development, producing a fogged final image after fixing. Further, the presence of many toner particles that are weakly charged reduces the force of adhesion between toner and carrier particles and in magnetic brush development, toner particles that are being transported through the developing space will spin off the magnetically rotating carrier particles under centrifugal force. As a consequence, the charging device, the exposure optical system and other units in the copying machine will be fouled by the toner particles, causing defects such as unevenness and clear spots in the finally obtained fixed image.

In conventional toners of a negatively chargeable type, silica particles finer than toner particles are mixed with the latter so that they are deposited on the surfaces of toner particles to prevent agglomeration of the latter and to insure high fluidity. However, the conventionally used fine silica particles have such a strong tendency to be negatively charged that if they are mixed with toner particles so as to be deposited on the surfaces of the latter, the resulting tonor will have negative, rather than positive, chargeability. As a result, the toner has the same polarity as that of the negatively charged electrostatic latent image formed on the photoreceptor, thus making it impossible to effect electrostatic development.

With a view to solving these problems, the following techniques have been proposed:

(1) using positively chargeable fine particles treated with a silane coupling agent (see Unexamined Published Japanese Patent Application Nos. 53-66235 and 56-123550, and Examined Japanese Patent Publication No. 53-22447); and (2) using positively chargeable fine particles treated with silicone oil (see Unexamined Published Japanese Patent Application Nos. 58-60754 and 59-187359).

However, charging toners positively does not suffice for image of good quality to be maintained consistantly for a prolonged period of time. Toner is subjected to mechanical agitation in the developing unit in order to achieve its electrification through friction with the surface of carrier particles. If the toner is put to cyclic use, part of the toner components will stick to the surface of carrier particles (this phenomenon is hereinafter referred to as "toner loss"). In case of a resin-coated carrier, the resin forming the carrier surface will gradually wear to reduce the carrier's surface area which is effective in imparting an appropriate amount of triboelectric charges. In either case, the amount of triboelectrification on the toner decreases to increase the chance of toner particles of flying about in the copying machine or of the occurrence of fogging.

With the recent demand for reducing the size, power consumption and copying cost of electrophotographic copiers, a developer is desired that need only be used in a small amount and which yet is capable of producing image of good quality in a consistent way over a prolonged period. In other words, a toner is desired that can be provided with a sufficient amount of triboelectrification to produce image of good quality even if the surface area of carrier is reduced on account of using the developer in a smaller amount.

SUMMARY OF THE INVENTION

An object, therefore, of the present invention is to provide a developer that is free from the aforementioned defects of the conventional two-component developer, i.e., carrier deterioration decrease in its ability to impart triboelectric charges to toner and decrease in the chance of imparting triboelectric charges on account of using the developer in a smaller amount. The developer of the present invention allows toner to be electrified at a markedly improved rate and it yet has higher endurance.

The above-stated object of the present invention can generally be attained by an electrostatic latent image developer that is composed of at least three components, toner resin particles that contain at least a colorant, carrier particles and fine inorganic particles. The improved feature of the developer is that said toner resin particles contain a resin crosslinked with a divalent metal or metals of higher valency and that said fine inorganic particles are surface-treated with an ionic silicone compound.

DETAILED DESCRIPTION OF THE INVENTION

The developer of the present invention may be designed in such a way that the time required for triboelectric charges on toner to saturate can be reduced to no longer than 5 minutes or even to no longer than 1 minute. This electrical characteristic of the developer is measured by a blow-off method after performing a shaking test by the following procedure: 20 g of the developer which has been conditioned to have a toner concentration of 5 wt % is put into a commercial sample jar PS-20A having an outside diameter of 27 mm and a height of 55 mm (product of Konica Corp.) and left to stand at 20° C. and 65% r.h. for 24 h; thereafter, the sample is shaken for 120 min on a shaker Model NEWYSCH-5 (Yayoi Co., Ltd.) set to 150 stokes/min.

In order to insure that copies of good image quality are obtained over a prolonged period, the electrical characteristic measured by the method described above must not exceed 5 minutes. Compared to a conventional developer, the developer of the present invention permits triboelectric charges on toner to saturate at least four times as fast. It is difficult to explain exactly why the developer of the present invention has this unique feature but probably the presence of fine inorganic particles treated with an ammonium salt modified polysiloxane would permit appropriate positive triboelectric charges to be imparted to toner in a consistent way. Further, the ionically crosslinked resin in the toner would be readily polarized to facilitate the build-up of electric charges.

The developer of the present invention insures the formation of image of good quality in many cycles of use. The toner in the developer is capable of so fast triboelectrication that the decrease in the efficiency or chance of imparting triboelectric charges on account of the fouling of the sleeve surface or the wear of the carrier surface is effectively compensated to insure that the proper amount of triboelectrification is maintained consistently for a much longer period than when the conventional two-component developer is used. As a result, image of good quality can be obtained in many cycles without toner particles flying about in the copying machine.

The resin crosslinked with a polyvalent metal which is used in the present invention is preferably a styrene-acrylic copolymer resin crosslinked with a polyvalent metal (which is hereinafter sometimes referred to as "a metal-crosslinked St-Ac copolymer resin"). The copolymer in the metal-crosslinked St-Ac copolymer resin is preferably a polymer prepared by using as essential components a styrene monomer and at least one comoner selected from among acrylic and methacrylic acid ester monomers. A carboxyl group is preferably used as a reactive group for forming bonds to be crosslinked with a metal. A styrene-acrylic copolymer having such a carboxyl group may be obtained by copolymerizing three essential components, i.e., a styrene monomer, an acrylate or methacrylate ester monomer and a monomer selected from among acrylic acid, methacrylic acid and derivatives thereof.

A preferred monomer having a carboxyl group as a reactive group for forming bonds to be crosslinked with a metal is a half-ester compound of a structure that is obtained by esterification between a hydroxyl-containing acrylate ester or methacrylate ester or derivatives thereof and a dicarboxylic acid compound. This half-ester compound has carboxyl groups introduced at positions that will not substantially affect the backbone structure, so steric hindrance in the chemical structure is sufficiently reduced to insure efficient progress of the reaction between carboxyl groups and the polyvalent metal compound to be described later in this specification. As a result, ionic bonds which are far weaker than covalent bonds will form to produce a resin having a desired structure of crosslinking.

Illustrative styrene monomers that can be used in synthesizing the copolymer described above include styrene, o-methylstyrene, m-methylstyrene, p-methylstyrene, α-methylstyrene, p-ethylstyrene, 2,3-dimethylstyrene, p-butylstyrene, p-hexylstyrene, p-dodecylstyrene, p-methoxystyrene, p-chlorostyrene, etc. Among these, styrene is particularly preferred. The proportion of styrene is preferably within the range of 50–95 wt % of the copolymer. By selecting this preferred proportion of styrene, the efficiency of grinding in the toner production process is improved to insure efficient manufacture of toner particles having a desired size.

Illustrative acrylic monomers that can be used in the production of said copolymer include: acrylate esters such as methyl acrylate, ethyl acrylate, butyl acrylate, isobutyl acrylate, propyl acrylate, octyl acrylate, dodecyl acrylate, lauryl acrylate, 2-ethylhexyl acrylate, stearyl acrylate, 2-chloroethyl acrylate, phenyl acrylate and methyl α-chloroacrylate; and methacrylate esters such as methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, and diethylaminoethyl methacrylate.

Illustrative carboxyl-containing compounds which are used to form the half-ester compound include aliphatic dicarboxylic acid compounds such as malonic acid, succinic acid and glutaric acid, and aromatic dicarboxylic acid compounds such as phthalic acid. Half-ester compounds can be obtained by esterifying these carboxyl-containing compounds with a hydroxyl-containing acrylate ester or methacrylate ester or derivatives thereof. The dicarboxylic acid compounds mentioned above may have the hydrogen atom replaced by halogen atoms, lower alkyl groups, alkoxy groups, etc. Alternatively, they may be acid anhydrides.

Illustrative acrylic or methacrylic acid derivatives containing a hydroxyl group are those which have at least one mole of an alkylene oxide such as ethylene oxide or propylene oxide added to acrylic or methacrylic acid. Other examples are hydroxyalkyl esters obtained by esterifying acrylic or methacrylic acid with a dihydric alcohol such as propylene glycol.

The preferred half-ester compound described above may be represented by the following general formula (1):

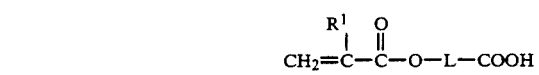

(1)

where L is a divalent linkage group of three or more carbon atoms which has an ester bond in the molecule chain and may have a substituent; and $R^1$ is a hydrogen atom or a methyl group.

Illustrative dicarboxylic acid compounds used to obtain the half-ester compound represented by the general formula (I) include moneacryloyloxyethyl succinate, monoacryloyloxypropysuccinate, monoacryloyloxyethyl glutarate, monoacryloyloxyethyl phthalate, monoacryloyloxypropyl phthalate, monomethacryloyloxyethyl succinate, monomethacryloyloxypropyl succinate, monoacryloyloxyethyl glutarate, monoacryloyloxyethyl phthalate, and monomethacryloyloxypropyl phthalate.

The copolymer in the metal-crosslinked St-Ac copolymer resin preferably has such monomer unit contents that the acrylate or methacrylate ester monomer is present in an amount of 5-50 wt %, with the half-ester compound being present in an amount of 0.5-30 wt %, more preferably 1-20 wt %. By selecting these preferred monomer proportions, satisfactory anti-offset property, storage stability and resistance to plasticizers can be attained.

Illustrative crosslinking polyvalent metal elements that may be used to obtain the metal-crosslinked St-Ac copolymer resin include Cu, Ag, Be, Mg, Ca, Sr, Bz, Zn, Cd, Al, Ti, Ge, Sn, V, Cr, Mo, Mn, Fe, Ni, Co, Zr, Se, etc. Among these polyvalent metal elements, alkaline earth metals such as Be, Mg, Ca, Sr and Ba, and zinc family elements such as Zn and Cd are preferred, with Mg and Zn being particularly preferred.

Illustrative polyvalent metal compounds containing the metals listed above include fluorides, chlorides, chlorates, bromides, iodides, oxides, hydroxides, sulfidss, sulfites, sulfates, selenides, tellurides, nitrides, nitrates, phosphides, phosphinates, phosphates, carbonates, orthosilicates, acetates, oxalates, and lower alkyl (e.g. methyl or ethyl) compounds of the metal elements described above. Among these, acetates and oxides of the metal elements described above are particularly preferred.

The polyvalent metal compounds are generally used in amounts ranging from 0.1-1 mole per mole of the half-ester compound charged.

The styrene-acrylic copolymer may preferably be reacted with the polyvalent metal compound by the following method: a solution containing the styrene-acrylic copolymer obtained by, for example, solution polymerization is mixed with the polyvalent metal compound or a dispersion thereof; the mixture is heated to remove the solvent for about 1-3 hours; when the temperature in the reaction system reaches 150°-180° C., the mixture is maintained at that temperature for at least one hour to complete the reaction. Depending on the case, the polyvalent metal compound may be charged into the reaction system together with the solvent prior to starting polymerization for obtaining the styrene-acrylic copolymer, or the styrene-acrylic copolymer and polyvalent metal compound which are obtained by solvent removal may be allowed to react with each other by mixing them in molten state by means of such a device as a roll mill, kneader of an extruder.

The metal-crosslinked St-Ac copolymer resin preferably has a molecular weight distribution that is divided into at least two component groups, one corresponding to a polymer component of the lower molecular weight and the other corresponding to a component of the higher molecular weight. By performing molecular weight design in this manner, further improvements can be achieved in low-temperature fixability, resistance to offsetting under hot conditions, and storage stability. At the same time, formation of fine toner particles can be positively prevented.

The toner in the developer of the present invention may contain various additives as required. Exemplary additives that may be incorporated include colorants, charge control agents, agents to improve fixability, etc. Illustrative colorants include carbon blank, Chrome Yellow, DuPont Oil Red, Quinoline Yellow, Phthalocyanine Blue, Malachite Green oxalate and lamp black. These colorants are generally contained in amounts ranging from about 1 to 20 parts by weight per 100 parts by weight of the metal-crosslinked St-Ac copolymer resin. Illustrative charge control agents include metal complex dyes, nigrosine dyes and ammonium compounds. Illustrative agents capable of improving fixability include polyolefins, alphatic acid esters, partially saponified aliphatic acid esters, paraffin wax, polyamide based waxes. Waxes having softening points of 60°-180° C. as measured by the ring and ball test method described in JIS K 2531 are particularly preferred.

The fine inorganic particles which are another component of the electrophotographic developer of the present invention are those which have been treated with an "ionic silicone compound". The "ionic silicone compound" may be exemplified by a polysiloxane having an ammonium salt as a functional group, more specifically by dimethyl polysiloxane having an ammonium salt group. By using said ammonium salt modified polysiloxane, a toner that has satisfactorily high positive chargeability and which exhibits consistent chargeability in the face of environmental changes can be obtained. Further, the toner allows for efficient cleaning of the photoreceptor.

The dimethyl polysiloxane having an ammonium salt group is generally a dimethyl polysiloxane containing a structural unit represented by the structural formula A shown below, which is more specifically represented by the structural formula B shown below:

Structural formula A

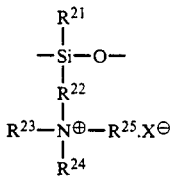

($R^{21}$ is a hydrogen atom, a hydroxyl group, alkyl group, an aryl group, an alkoxy group, or

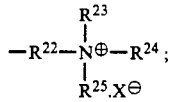

$R^{22}$ is a linkage group exemplified by an alkylene group, an arylene group, an aralkylene group, —NH—, —NH-CO— or combinations of these groups; $R^{23}$, $R^{24}$ and $R^{25}$ are each a hydrogen atom, an alkyl group or an aryl group; X is a halogen atom; $R^{21}$-$R^{25}$ may have a substituent);

Structural formula B

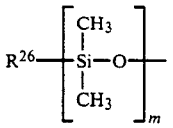

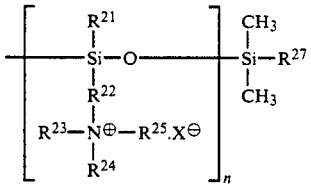

($R^{26}$ and $R^{27}$ are each a hydrogen atom, a hydroxyl group, an alkyl group, an aryl group or an alkoxy group, which may have a substituent; $R^{21}$-$R^{25}$ and X are each the same as defined for structural formula A; m and n are each an integer of 1 or more).

Specific examples of

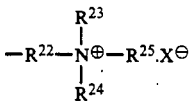

include but are not limited to those which are represented by the following structural formulas.

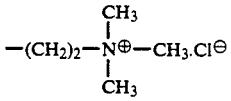

(1)

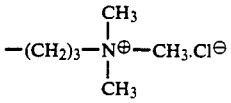

(2)

-continued

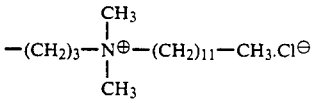

(3)

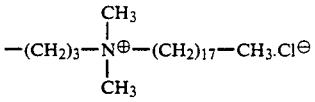

(4)

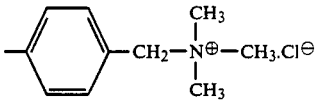

(5)

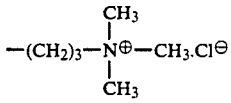

(6)

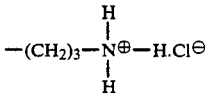

(7)

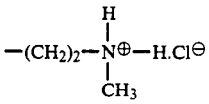

(8)

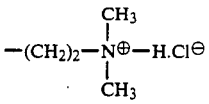

(9)

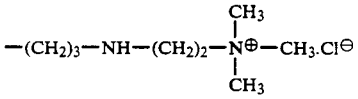

(10)

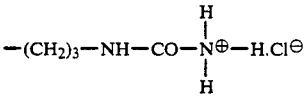

(11)

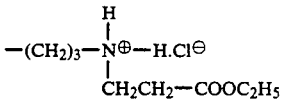

(12)

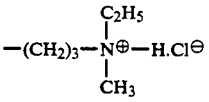

(13)

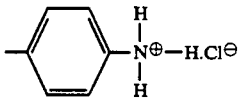

(14)

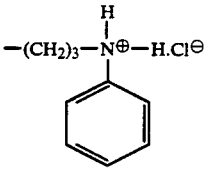

(15)

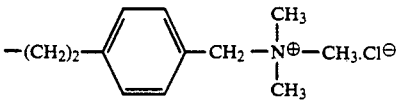

(16)

-continued

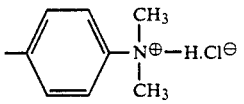

(17)

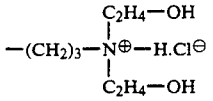

(18)

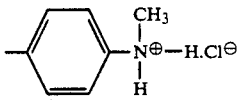

(19)

The polysiloxane having an ammonium salt as a functional group may be prepared by various methods. In one method, an organohalogenosilane having an ammonium salt as a functional group and an organohalogenosilane having no ammonium salt group are copolymerized. In another method, a polysiloxane obtained by polymerizing an organohalogenosilane is partly modified by an organic group having an ammonium salt as a functional group. If desired, an organoalkoxysilane may be used in place of the organohalogenosilane. Some polysiloxane compounds having an ammonium salt as a functional group are commercially available.

Illustrative fine inorganic particles that may be treated with the ammonium salt modified polysiloxane include the fine particles of such inorganic materials as silica, alumina, titanium oxide, barium titanate, magnesium titanate, calcium titanate, strontium titanate, zinc oxide, chromium oxide, cerium oxide, antimony trioxide, zirconium oxide and silicon carbide. Fine silica particles are particularly preferred for use as fine inorganic particles from the viewpoint of improved fluidity.

Known techniques may be employed in treating the surfaces of inorganic fine particles with the ammonium salt modified polysiloxane. Two examples are given below; in one method, fine inorganic particles are dispersed in a solution of the ammonium salt modified polysiloxane in a solvent, and the dispersion is filtered or spray-dried to remove the solvent, followed by curing of the residue with heat; in another method, fine inorganic particles are spray-coated with a solution of the ammonium salt modified polysiloxane in a solvent by means of a fluidized bed apparatus, followed by thermal drying to remove the solvent and cure the coating film.

The fine inorganic particles thus surface-treated with the ammonium salt modified polysiloxane preferably have an average size of 3 mμ–2 μm, more preferably 5 mμ–500 mμ, in terms of primary particles. Such inorganic particles have a specific surface area of 20–500 $m^2/g$ as measured by the BET method. If the average particle size and specific surface area of the inorganic particles are within the ranges specified above, the developer of the present invention can be cleanly wiped off with a blade. Further, the developer has satisfactory fluidity to insure the formation of image having adequate and uniform density.

The fine inorganic particles treated with the ammonium salt modified polysiloxane are put to use after being deposited on the surfaces of toner particles by being added and mixed with the latter externally.

The fine inorganic particles are preferably contained in amounts ranging from 0.1 to 2.0 wt % of the toner, with the range of 0.2–1 wt % being particularly preferred. If the content of these inorganic particles is within these ranges, not only are appropriate degrees of positive chargeability and fluidity achieved but also consistent chargeability is exhibited in the face of environmental changes. Further, the appropriate degree of positive chargeability can be imparted over a prolonged period without permitting free inorganic particles to foul the carrier particles, the development sleeve or the interior of the copying machine.

The carrier which is the third component of the electrophotographic developer of the present invention may be a resin-coated carrier which has the surface of magnetic particles coated with a resin. The particles of materials that are magnetized strongly in the direction of an applied magnetic field may be used as magnetic particles and they include the particles of iron and other ferromagnetic metals such as nickel and cobalt, as well as alloys thereof such as ferrite and magnetite, and compounds containing these elements. Ferrite may advantageously be used in the present invention. Ferrite which is an oxide has a smaller specific gravity than nickel and other metals.

Because of its lightweightness, ferrite can be readily mixed with toner under agitation and the density of toner and the amount of triboelectrification can be rendered sufficiently uniform to improve the durability of the resulting developer.

The carrier may advantageously be coated with such resins as a styrene-acrylic copolymer, a silicone resin, a fluorine resin, etc. Fluorine resins are particularly preferred since they impart positive chargeability to toner and render it highly resistant to toner loss. Useful fluorine resins are not limited to any particular types but those which have a surface energy of 10–28 dynes/cm and which exhibit high resistance to toner loss, impact and wear are preferred. Examples of such preferred fluorine resins include polymer resins made of monomers represented by the following general formula (a); copolymer resins made of monomers represented by said general formula (a) and other monomers; vinylidene fluoride-tetrafluoroethylene copolymer resin; and blends of these and other resins:

General formula (a)

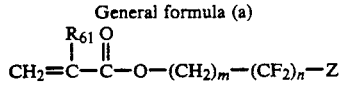

(where $R^{61}$ is a hydrogen atom of a methyl group; m is an integer of 1–8; n is an integer of 1–19; and Z is a hydrogen atom or a fluorine atom).

Among the monomers embraced by the general formula (a), those which are represented by the following general formulas (b) and (c) ar particularly preferred from the viewpoint of chargeability:

General formula (b)

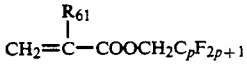

General formula (c)

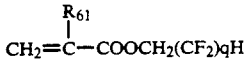

(where $R^{61}$ is a hydrogen atom or a methyl group; p is an integer of 1–2; and q is an integer of 2–4).

Particularly preferred monomers include 1,1-dihydroperfluoroethyl methacrylate and 1,1,3-trihydroperfluoropropyl methacrylate. Other useful monomers include methyl acrylate, ethyl acrylate, butyl acrylate, benzyl acrylate, acrylamide, cyclohexyl acrylate, glycidyl acrylate, hydroxyethyl acrylate, methyl methacrylate, ethyl methacrylate, butyl methacrylate, benzyl methacrylate, methacrylamide, cyclohexyl methacrylate, glycidyl methacrylate, hydroxyethyl methacrylate, styrene, etc.

The following are non-limiting examples of preferred fluorine resins:

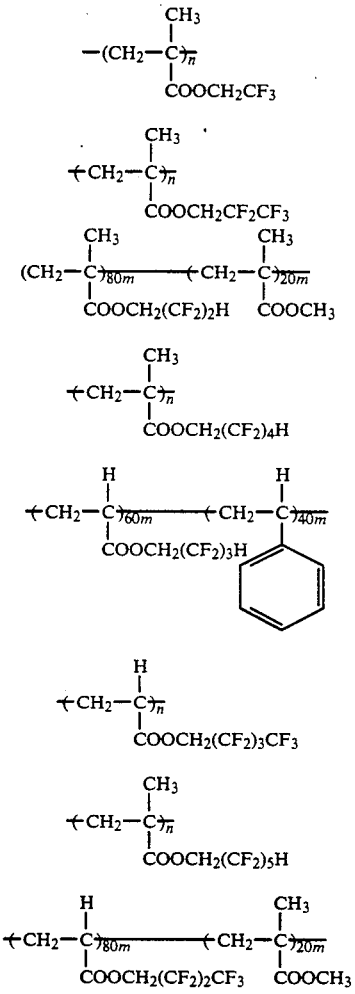

(where n and m each represents the degree of polymerization and may be any integer; each of the formulas shown above may be terminated with any group).

The molar ratio of vinylidene fluoride to tetrafluoroethylene in the vinylidene fluoride-tetrafluoroethylene copolymer resin is preferably within the range from 75:25 to 95:5, with the range from 75:25 to 87.5:12.5 being more preferred. Outside these ranges, resin's solubility in solvents decreases and its ability to form films in the coating step deteriorates to cause occasional formation of weak coating films. Thus, from the viewpoint of improving the durability of resin-coated carriers, the resin material is required to have high solubility in solvents, good film forming ability and a capability of forming strong films, and these requirements can be satisfied by copolymerizing vinylidene fluoride and tetrafluoroethylene in the molar ratios within the ranges specified above.

The resin coated carrier may be produced by the following procedure: a fluorine resin or a mixture thereof with other resins is dissolved in an organic solvent to prepare a coating solution, which is then applied to the surface of the particles of a carrier core material by a suitable method such as spray drying or a fluidized bed to form a coating layer; and the coated particles are heated, left to stand or otherwise processed. Stated more specifically, the particles of a carrier core material are carried by an ascending pressurized gas stream to a height at which their weight balances the gas pressure, and the particles are spray-coated with the coating solution by the time they fall down.

The resin coated carrier has a weight average particle size which preferably ranges from 20 to 200 μm, with the range of 40–150 μm being more preferred. If the weight average particle size of the carrier is smaller than 20 μm, the carrier particles will be deposited on a latent electrostatic image and cause the toner particles to fly about within the copying machine through a chain reaction involving a decrease in the number of carrier particles in the developing unit, a decrease in the efficiency of deposition of electric charges on toner, and a consequent decrease in the quantity of toner electrification. If the weight average particle size of the carrier is greater than 200 μm, the carrier particles have such a small surface area that the problem of toner flying also occurs on account of lower efficiency of charge deposition on toner. The term "weight average particle size of carrier" as used herein refers to the value measured with "Microtrack" of Nikkiso Co., Ltd.

The following examples are provided for the purpose of further illustrating the present invention but are in no way to be taken as limiting. Preparation of toner resins:

(1) Resin A1 (for use in the present invention)

Using 72 parts by weight of styrene (all "parts" that appear hereinafter are on a weight basis), 10 parts of methyl methacrylate, 14 parts of butyl acrylate, 4 parts of monoacryloyloxyethyl succinate and 0.5 parts of zinc oxide, a metal-crosslinked styrene-acrylic copolymer resin having a dual-peak molecular weight distribution was prepared. This resin had a weight average molecular weight (Mw) of 170,000 and a number average molecular weight (Mn) of 9,000. It was designated as "resin A1".

(2) Resin A2 (for use in the present invention)

Using 82 parts of styrene, 14 parts of butyl acrylate, 4 parts of monoacryloyloxyethyl isophthalate and 0.6 parts of magnesium oxide, a metal-crosslinked styrene-acrylic copolymer resin having a dual-peak molecular weight distribution was prepared. This resin had a weight average molecular weight (Mn) of 186,000 and a number average molecular weight (Mn) of 10,000. It was designated as "resin A2".

(3) Resin al (for use as comparison)

Using 82 parts of styrene and 18 parts of butyl methacrylate, a styrene-acrylic copolymer resin which was not metal-crosslinked but which had a dual-peak molecular weight distribution was prepared. This resin had a weight average molecular weight (Mn) of 152,000 and a number average molecular weight (Mn) of 6,800. It was designated as "resin a1".

Preparation of fine inorganic particles:

(1) Fine inorganic particles B1 (for use in the present invention)

A polysiloxane whose structural unit contained an ammonium salt as a functional group as shown by the following structural formula was dissolved in xylene to prepare a processing solution:

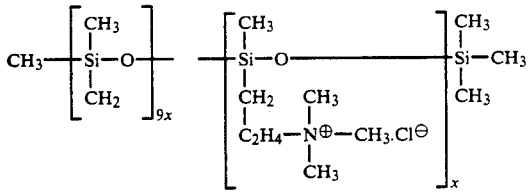

(x: integer).

In the next step, fine silica particles ("Aerosil 200" of Nippon Aerosil Co., Ltd.) were charged into a mixer and sprayed with the previously prepared polysiloxane in an amount of 5 wt % of the silica particles. The mixture was transferred into a flask and the solvent xylene was removed by heating at 200° C. for 5 hours under stirring, thereby obtaining fine inorganic particles surface-treated with the polysiloxane having an ammonium salt as a functional group. They were designated as "fine inorganic particles B1", which had an average size of 12 mμ in terms of primary particles and a specific surface area of 115 $m^2/g$ as measured by the BET method.

(2) Fine inorganic particles B2 (for use in the present invention)

A polysiloxane whose structural unit contained an ammonium salt as a functional group as shown by the following structural formula was dissolved in xylene to prepare a processing solution:

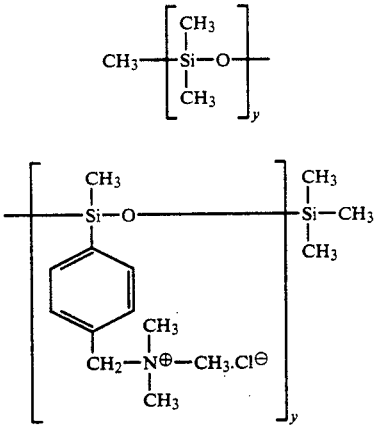

(y: integer).

In the next step, fine silica particles ("Aerosil 200") were charged into a mixer and sprayed with the previously prepared polysiloxane in an amount of 17 wt % of the silica particles. The mixture was subsequently treated as in the preparation of fine inorganic particles B1. The so prepared fine inorganic particles which were surface-treated with the polysiloxane having an ammonium salt as a functional group were designated as B2. The fine inorganic particles B2 had an average size of 7 mμ in terms of primary particles and a specific surface area of 126 $m^2/g$ as measured by the BET method.

(3) Fine inorganic particles B3 (for use in the present invention)

A polysiloxane whose structural unit contained an ammonium salt as a functional group as shown by the following structural formula was dissolved in xylene to prepare a processing solution:

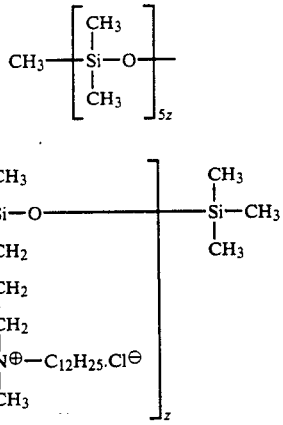

(z:integer).

In the next step, fine silica particles ("Aerosil 200") were charged into a mixer and sprayed with the previously prepared polysiloxane in an amount of 10 wt % of the silica particles. The mixture was subsequently treated as in the preparation of fine inorganic particles B1. The so prepared fine inorganic particles which were surface-treated with the polysiloxane having an ammonium salt as a functional group were designated as B3. The fine inorganic particles B3 had an average size of 12 mμ in terms of primary particles and a specific surface area of 93 $m^2/g$ as measured by the BET method.

(4) Fine inorganic particles b1 (for use as comparison)

Fine silica particles ("Aerosil 200") were charged into a closed Henschel mixer heated at 100° C. A solution having an amino-containing silicone oil dissolved in isopropyl alcohol (viscosity, 1200 cPs; amino equivalent, 3,500) was sprayed onto the fine silica particles in such an amount that the amino-containing silicone oil was 2.0 wt %. The mixture was stirred at high speed while the spraying was effected. Subsequently, the mixture was dried at 150° C. to obtain comparative fine inorganic particles which were surface-treated with the amino-containing silicone oil. These fine inorganic particles were designated as b1.

Preparation of carriers:

(1) Carrier C1

Using a fluidized bed apparatus, the surfaces of ferrite particles ("F-150" of Nippon Teppun Kogyo K.K.) were coated with a fluorine resin (listed under ① hereinbefore) at a coverage of 2.5 wt % to prepare a resin-coated carrier, which was designated as carrier C1. This carrier had a weight average particle size of 80 μ. The carrier coating resin had a surface energy of 18.3 dynes/cm.

(2) Carrier C2

Using a fluidized bed apparatus, the surfaces of ferrite particles ("F-150") were coated with a fluorine resin (listed under ② hereinbefore) at a coverage of 2.5 wt % to prepare a resin-coated carrier, which was designated as carrier C2. This carrier had a weight average particle size of 80 μm. The carrier coating resin had a surface energy of 13.4 dynes/cm.

(3) Carrier C3

Using a fluidized bed apparatus, the surfaces of ferrite particles ("F-150") were coated with a vinylidene fluoride-tetrafluoroethylene copolymer resin (80:20 in molar ratio) at a coverage of 2.5 wt % to prepare a fluorine-based, crystalline resin coated carrier, which was designated as carrier C3. This carrier had a weight average particle size of 80 μm. The carrier coating resin had a surface energy of 24.8 dynes/cm. Measuring the surface energy of carrier coating resin:

Using methyl iodide ($\gamma H = 0.508\ Nm^{-1}$, 20° C.), the angle of contact was measured at 20° C. and the surface energy was calculated by the following equation:

$$\gamma_s^d = \frac{\gamma H}{4}(1 + \cos\theta)^2$$

(A New Course in Experimental Chemistry, vol. 18 "Interfacial Colloid", The Chemical Society of Japan, Maruzen, 1977, p. 102).

Measuring the shell coverage of carrier:

A 5-g sample of developer was treated with a surfactant and water to wash off the toner. The remainder was put into a vacuum dryer (60° C.) and dried for 3 hours until all water was removed. After measuring the weight of the resulting carrier, A (mg), the coating resin was washed off with acetone. After drying in the same manner as described above, the weight of the resulting core, B (mg), was measured. The shell coverage of carrier was calculated by $$\frac{A - B}{A} \times 100\ (\text{wt } \%).$$

Measuring the index of toner loss:

The carrier was separated from the developer by means of a surfactant. Nine (9.0) grams of the carrier was put into 100 ml of methyl ethyl ketone to dissolve away the coating resin. The transmittance of the solution at 500 nm was measured with a spectrophotometer (Model 330 of Hitachi Recording Spectrophotometer). The measured value was used as an index of toner loss.

With reference being made to Table 1, examples of the present invention and comparative examples are described below.

EXAMPLE 1

| | |
|---|---|
| Resin Al | 100 parts |
| Carbon black ("Mogul L" of Cabot Corporation) | 10 parts |
| Low-molecular weight polypropylene wax | 5 parts |

The ingredients mentioned above were mixed, kneaded in molten state by means of heated rolls, cooled, coarsely ground, finely ground with an ultrasonic jet mill, and air-classified to obtain a toner powder having an average particle size of 11.0 μm.

A hundred parts of this toner powder was mixed with 0.8 parts of fine inorganic particles B1 in a Henschel mixer. Five parts of the resulting composite toner was mixed with 100 parts of carrier C1 in a V-type mixer to obtain a developer.

Using a copying machine adapted from U-Bix 3042 (Konica Corp.) and equipped with a negatively chargeable photoreceptor, charging and exposure were effected and the electrostatic latent image was developed with 800 g of the developer placed in a U-Bix 3042 magnetic brush developing unit having a sleeve of 40 mmΦ adapted to move at a linear speed of 600 mm/sec. Subsequently, a dc corona discharge was applied at a negative voltage of about 3 kilovolts to the back side of receiving sheet, thereby transferring the toner image. The transferred image was fixed by means of heated rollers having a conductive carbon black dispersed in the coating layer.

A copying test was conducted at 20° C. and 65% r.h. to produce $2 \times 10^5$ prints. Sharp images were obtained without the flying about of toner particles, with negligible decrease in the amount of electric charges deposited on toner.

Prior to the copying test, the time required for triboelectric charges on toner to saturate was measured by the method described hereinabove and was found not to exceed 1 minute. At the initial stage of copying test, the amount of electricity on toner was 27.1 μC/g at a toner concentration of 5 wt % in the developing unit.

After completion of the copying of 2 x 10s prints, the shell coverage of carrier was 0.9 wt % and the index of toner loss was 55.2%. At the last stage of copying test, the amount of electricity on toner was 27.8 μC/g at a toner concentration of 5 wt % in the developing unit.

EXAMPLE 2

The procedure of Example 1was repeated except that binder resin was changed from A1 to A2. The results were substantially the same as in Example 1.

The time required for triboelectric charges on toner to saturate was about 5 minutes and the amount of initial electrification on toner was 26.2 μC/g. After completion of the copying of $2 \times 10^5$ prints, the shell coverage of carrier was 1.0 wt % and the index of toner loss was 56.4%. The amount of toner electrification at the last stage of copying test was 25.8 μC/g.

EXAMPLES 3-8 AND COMPARATIVE EXAMPLES 1-3

According to the combinations of binder resin, fine inorganic particles and carrier shown in Table 1, additional developer samples were prepared by the same procedure as used in Example 1. The samples were evaluated by the same method as used in Example 1.

The characteristics of the developers prepared in Examples 1-8 and Comparative Examples 1-3 and the results of evaluation of these developers are summarized in Tables 1 and 2, respectively.

TABLE 1

| | Developer's constitution | | | Time for toner | | | | Amount of toner electrification, μC/g | |
|---|---|---|---|---|---|---|---|---|---|
| | birder resin | fine inorganic particles | carrier | triboelectric charges to saturate, min | Amount of developer, g | Shell coverage of carrier, wt % | Index of toner loss, % | initial | end |
| Example No. | | | | | | | | | |
| 1 | A1 | B1 | C1 | ≦1 | 800 | $0.9/2 \times 10^5$ copies | $35.2/2 \times 10^5$ copies | 27.1 | 27.8 |

TABLE 1-continued

| | Developer's constitution | | | Time for toner | | | | Amount of toner electrification, μC/g | |
|---|---|---|---|---|---|---|---|---|---|
| | birder resin | fine inorganic particles | carrier | triboelectric charges to saturate, min | Amount of developer, g | Shell coverage of carrier, wt % | Index of toner loss, % | initial | end |
| 2 | A2 | B1 | C1 | ≦1 | 800 | 1.0/2 × $10^5$ copies | 36.4/2 × $10^5$ copies | 26.2 | 25.8 |
| 3 | A1 | B2 | C1 | ≦1 | 800 | 1.0/2 × $10^5$ copies | 34.1/2 × $10^5$ copies | 28.0 | 27.6 |
| 4 | A1 | B3 | C1 | ≦1 | 800 | 0.8/2 × $10^5$ copies | 39.2/2 × $10^5$ copies | 27.6 | 27.2 |
| 5 | A1 | B1 | C2 | ≦1 | 800 | 1.1/2 × $10^5$ copies | 39.1/2 × $10^5$ copies | 25.3 | 24.8 |
| 6 | A1 | B1 | C3 | ≦1 | 800 | 2.3/2 × $10^5$ copies | 30.6/2 × $10^5$ copies | 30.1 | 29.6 |
| 7 | A1 | B1 | C1 | ≦1 | 800 | 0.9/2 × $10^5$ copies | 38.2/2 × $10^5$ copies | 27.1 | 26.5 |
| 8 | A1 | B1 | C3 | ≦1 | 800 | 2.4/2 × $10^5$ copies | 37.6/2 × $10^5$ copies | 30.1 | 29.2 |
| Comparative Example | | | | | | | | | |
| 1 | a1 | B1 | C1 | ca.20 | 800 | 2.2/2 × $10^5$ copies | 82.1/5 × $10^4$ copies | 20.4 | 10.4 |
| 2 | A1 | b1 | C1 | ca.20 | 800 | 2.2/2 × $10^5$ copies | 84.3/5 × $10^4$ copies | 27.8 | 7.0 |
| 3 | a1 | b1 | C1 | ≧20 | 800 | 2.3/2 × $10^5$ copies | 80.1/5 × $10^4$ copies | 25.0 | 7.0 |

TABLE 2

| | | |
|---|---|---|
| Example | 1 | When a copying test was conducted to produce 2 × $10^5$ prints, sharp images could be obtained without the flying about of toner particles, with negligible decrease in the amount of toner electrification. |
| | 2 | When a copying test was conducted to produce 2 × $10^5$ prints, sharp images could be obtained without the flying about of toner particles, with negligible decrease in the amount of toner electrification. |
| | 3 | When a copying test was conducted to produce 2 × $10^5$ prints, sharp images could be obtained without the flying about of toner particles, with negligible decrease in the amount of toner electrification. |
| | 4 | When a copying test was conducted to produce 2 × $10^5$ prints, sharp images could be obtained without the flying about of toner particles, with negligible decrease in the amount of toner electrification. |
| | 5 | When a copying test was conducted to produce 2 × $10^5$ prints, sharp images could be obtained without the flying about of toner particles, with negligible decrease in the amount of toner electrification. |
| | 6 | When a copying test was conducted to produce 2 × $10^5$ prints, sharp images could be obtained without the flying about of toner particles, with negligible decrease in the amount of toner electrification. In addition, the decrease in the shell coverage of carrier was negligible. |
| | 7 | When a copying test was conducted to produce 2 × $10^5$ prints, sharp images could be obtained without the flying about of toner particles, with negligible decrease in the amount of toner electrification. |
| | 8 | When a copying test was conducted to produce 2 × $10^5$ prints, sharp images could be obtained without the flying about of toner particles, with negligible decrease in the amount of toner electrification. In addition, the decrease in the shell coverage of carrier was negligible. |
| Comparative Example | 1 | When a copying test was conducted to produce 5 × $10^4$ prints, the interior of the copying machine was fouled by scattering toner particles and the amount of toner electrification decreased already at the output of 3 × $10^4$ copies. |
| | 2 | Same as above except that the threshold value was 2 × $10^4$ copies. |
| | 3 | Same as above except that the threshold value was 2.5 × $10^4$ copies. |

The performance of the developer samples prepared in Examples 1–8 was evaluated by the same procedure as described above except that the copying machine was a version adapted from U-Bix 1012 (Konica Corp.) and equipped with a negatively chargeable photoreceptor, and that 400 g each of the developers was placed in a U-Bix 1012 magnetic brush developing unit having a sleeve of 30 mmΦ adapted to move at a linear speed of 250 mm/sec. The developers tested had satisfactory endurance and performed substantially as well as in the previous test.

What is claimed is:

1. In an electrostatic latent image developer that is composed of at least three components, toner resin particles containing at least a colorant, carrier particles and fine inorganic particles, the improvement wherein said toner resin particles contain a styrene-acrylic copolymer resin crosslinked with a divalent metal or metals of higher valency, and said fine inorganic particles being surface-treated with an ammonium ionic silicone compound.

2. An electrostatic latent image developer according to claim 1 wherein the proportion of styrene is within the range of 50 to 95 wt % of the said copolymer.

3. An electrostatic latent image developer according to claim 1 wherein said copolymer has such monomer unit contents that the acrylate or methacrylate ester monomer is resent in an amount of 5 to 50 wt %, with the half-ester compound being present in an amount of 0.5 to 30 wt %.

4. An electrostatic latent image developer according to claim 1 wherein crosslinking polyvalent metal elements that may be used to obtain said metal-crosslinked resin are alkaline earth metals such as Be, Mg, Ca, Sr and Ba, and zinc family elements such as Zn and Cd.

5. An electrostatic latent image developer according to claim 1 wherein polyvalent metal compounds that may be used to obtain said metal-crosslinked resin are acetates or oxides of the metal elements.

6. An electrostatic latent image developer according to claim 1 wherein said copolymer resin has a molecular weight distribution that is divided into at least two component groups, one corresponding to a polymer component of the lower molecular weight and the other corresponding to a component of the higher molecular weight.

7. An electrostatic latent image developer according to claim 1 wherein said ionic silicone compound is a dimethyl polysiloxane having an ammonium salt group.

8. An electrostatic latent image developer according to claim 1 wherein said fine inorganic particles are fine silica particles.

9. An electrostatic latent image developer according to claim 1 wherein said carrier is a resin-coated carrier which has the surface of magnetic particles coated with a fluorine resin.

* * * * *